United States Patent [19]

Leech

[11] Patent Number: 4,663,056

[45] **Date of Patent: * May 5, 1987**

[54] VACUUM-SEWAGE-COLLECTION SYSTEM

[76] Inventor: Edward H. Leech, 721 Edgar Dr., Salisbury, Md. 21801

[ * ] Notice: The portion of the term of this patent subsequent to Aug. 20, 2002 has been disclaimed.

[21] Appl. No.: 696,186

[22] Filed: Jan. 29, 1985

[51] Int. Cl.[4] ..... C02F 1/00

[52] U.S. Cl. ..... 210/744; 137/205; 137/433; 137/192; 210/117; 210/118; 210/121; 210/123; 134/18

[58] Field of Search ..... 210/121, 123, 117, 170, 210/513.5, 100, 744, 257.1, 258; 137/192, 205, 433, 430, 399, 427, 255; 134/18

[56] References Cited

U.S. PATENT DOCUMENTS

| | | | |
|---|---|---|---|
| 3,224,460 | 12/1965 | Cann, III | 137/205 |
| 4,333,830 | 6/1982 | Michael | 210/170 |
| 4,333,831 | 6/1982 | Petzinger | 210/170 |
| 4,396,435 | 8/1983 | West et al. | 134/18 |
| 4,489,744 | 12/1984 | Merrill | 137/433 |
| 4,492,630 | 1/1985 | Rymal, Jr. | 210/258 |
| 4,497,714 | 2/1985 | Harris | 210/123 |
| 4,535,800 | 8/1985 | Leech | 137/205 |

*Primary Examiner*—Andrew H. Metz
*Assistant Examiner*—Sharon T. Cohen
*Attorney, Agent, or Firm*—John F. McClellan, Sr.

[57] ABSTRACT

Holding tanks in an extremely simple vacuum-sewage system can provide high volume storage against emergencies such as vacuum pump failure, while providing under normal circumstances frequent, sudden, small-volume discharges in which any one holding tank discharge may trigger one or more others as in a cascade sequence, precluding conditions that might produce septic accumulations. Each holding tank has a float valve with a float that can be held on the respective valve seat, against buoyancy by sewage, by conventional vacuum pumping of the main. When vacuum in the main is degraded by use of a special valve or switch for the purpose or by holding tank discharge, holding tanks are selectively discharged as a result.

8 Claims, 2 Drawing Figures

VACUUM-SEWAGE-COLLECTION SYSTEM

CROSS-REFERENCE TO RELATED APPLICATION

Cross-reference is made to applicant's copending application Ser. No. 594,038, filed 3-27-84 for Valve System for Vacuum Sewage Collection System.

FIELD OF THE INVENTION

This application relates generally to sewage systems and particularly to an improved vacuum type sewage system.

BACKGROUND OF THE INVENTION

U.S. Pat. No. 4,333,830 to H. Michael, 6-8-82, disclosed a vacuum drain system with a series of collection stations.

U.S. Pat. No. 3,224,460 to H. E. Cann III, 12-21-65, disclosed a representative form of ball valve.

Vacuum drain systems with separate electrical or other arbitrary controls of scouring are known.

SUMMARY OF THE INVENTION

Vacuum operated sewage systems provide known advantages, such as lower initial construction costs. Lines can follow topography and such systems provide an economically viable system to separate sanitary sewage from combined storm and sanitary sewers. However, no system available is believed to be entirely satisfactory in preventing septic conditions, and in reducing complexity to an absolute minimum.

A principal object of the invention is to provide a new and substantially improved system of holding tanks in vacuum operated sewage collection systems.

Another object is to provide a system as described in which valve action is more sudden and positive and includes interaction of valving at different locations.

Further objects are to provide a system as described that operates automatically and reliably, and that can be remotely controlled for scouring, for reducing peak loads and for similar purposes, without special electrical or other connections or apparatus at the tanks, including having selective control of different units by volume of sewage at the units.

Still further objects are to provide a system as described that is simple and economical to make, install, adjust and operate, with low maintenance costs. "Open tank" problems associated with present valve systems would be essentially eliminated as result of the mechanical and operational simplicity of this system.

Yet further objects are to provide a system as described that is compatible with present on-line systems, that has a substantial reserve capacity, that can maintain portage in locations where maintenance of portage is a problem, and that is resistant to clogging and freezing.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figures 1, 2:
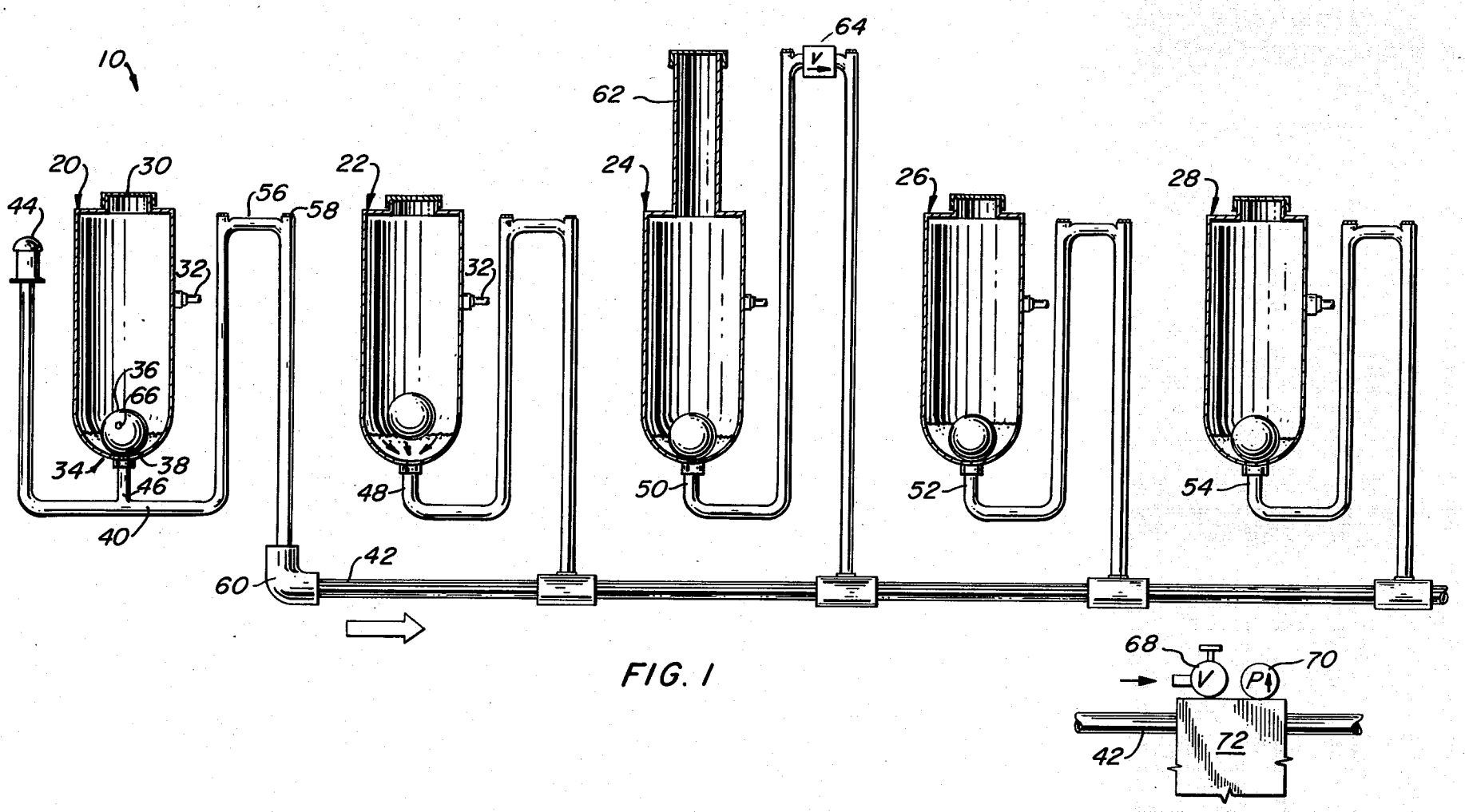
FIG. 1 is a partially sectional elevational diagram of a preferred embodiment of the invention.
FIG. 2 is a detail of associated equipment.

My aforesaid U.S. patent application details a tank and a float valve in the lower portion; the float valve may have a surface contoured as by grooving to permit seepage of sewage therepast. A simple ballast provision for the ball float permits introduction of ballast to the interior by means of a screw plug that can be unscrewed and removed to provide access to the hollow interior of the ball float. The same can apply here.

FIGS. 1 and 2 diagram a representative embodiment 10 of the invention, and particularly make evident the extreme simplicity of it.

An exemplary plurality of holding tanks 20, 22, 24, 26, 28, with vents 30 in the tops, are connected to prevent septic holding conditions by causing discharge to occur in one or more of the tanks as a result of being filled to a particular low level, triggering a cascade discharge by interaction among other tanks that contain sewage to various levels, none approaching more than fractional capacity (1/10 for example) of the tank. This prevents septic accumulations, through frequent discharge.

Input of sewage to each of the tanks occurs by gravity flow from a respective source through a respective lateral pipe 32 fixed well above the tank discharge valve 34, as, for example, more than half the tank length above it. The tank discharge valve includes a ball or hollow spherical float 36, preferably resting on a seat 38 provided as part of a drain pipe connection 40 to a vacuum main 42.

The vacuum main may have a conventional air inlet valve 44 and it may be at the upstream or higher end of the system; this may conventionally admit a quantity of air, or may be omitted. From the upstream end the vacuum main extends past a respective discharge 46, 48, 50, 52, 54 at the bottom or discharge end of each tank in turn. Each discharge and drain pipe extend down, then to the side and then rise as a trap 56 to a level near the top of each tank, where it may have clean out plug 58 and from there descend to a junction 60 connecting to the vacuum main 42.

A respective riser 62 may be provided for any or all the tanks according to conventional practice, and one or more check valves 64 may be provided according to conventional practice, as traps, or with traps 56.

A vacuum pump is conventionally connected adjacent the downstream end of the main. The system can be as large or as small as desired, assuming capacity of the elements proper for the purposes described.

The vacuum biases each float 36 down on a respective seat 38 until sufficient sewage is received to float it free of the seat according to predetermined specifications. Buoyancy is adjustable by inserting ballast through a plug 66 into the interior.

In operation, any one of the tanks (22 shown discharging) receives from a lateral drain 32 sufficient sewage to float it free of the seat 38 against the vacuum bias, discharging the contents.

Even though none of the other tanks may have collected enough sewage to float the ball in it against the combined weight of the ball and the vacuum bias, discharge of a first tank, for example 22, will tend to promote discharge of others by degrading the vacuum pumped. Discharge of the first tank reduces the downward force exerted on the others by the differential between the interior of the tank, which is at atmospheric pressure, and the vacuum-pumped main 42.

So, pre-immersion in sewage of a small part of a float can cause it to pop free and rise, on relief of the vacuum bias. Several floats may rise in this way in succession, each further degrading the vacuum and promoting discharging of additional tanks that contain less sewage.

Degrading the vacuum may occur through release of flowing material as a moving volume but taxing the vacuum pump and system capacity, and/or may occur as a result of temporary blockage or constriction of the pumping channel by sewage discharge. Upstream-downstream direction or sequence of discharging holding tanks is not crucial and is not necessarily predictable unless tank collections are monitored. On some occasions all tank floats in a system may "pop" simultaneously.

In short, in an extremely simple sewage system, large tank-capacity to provide high volume storage is available against emergencies, as when a vacuum pump or power might fail, while at the same time under normal circumstances, frequent, sudden, pop-loose type valving causes small-volume discharges and prevents septic accumulations. In this system, viscosity of sewage is probably less a consideration, because of the more violent valve action.

Selective operation provided by the system reduces losses that might otherwise occur. Loss of power, or pump failure will, after an interval, cause all floats to rise. After such, resumption of vacuum pumping will clean the nearest parts of the system first and then those successively more remote, without unnecessary quantities of air having been admitted to the system.

In an embodiment like that illustrated, cylindrical holding tanks 36 to 68 inches (0.8 by 1.7 m) with spherical bottoms may be used. Balls may be 16 inches (0.4 m) in diameter with seats proportioned for use with three inch (6.8 cm) pipe for the discharge line. The main may be of six inch (15 cm) pipe.

Each tank can receive sewage from at least four domestic dwellings.

The number of tanks installed will be limited only by the operative vacuum of the system, the size of the collection mains and the capacity of the particular conventional waste water ejection system used at the downstream end.

FIG. 2 shows an auxiliary valve provision at 68 adjacent the vacuum pump 70 and tank 72 connected to the main 42. The system may be scoured using auxiliary arbitrary-control valve 68 to degrade the vacuum and promote rising of the floats for scouring any tanks not scoured by cascade action for any reason. The valve can, of course, be electrically or otherwise actuated as desired. Scouring may also be accomplished by turning vacuum pumps on and off manually or automatically, under proper conditions.

This invention is not to be construed as limited to the particular forms disclosed herein, since these are to be regarded as illustrative rather than restrictive. It is, therefore, to be understood that the invention may be practiced within the scope of the claims otherwise than as specifically describe.

What is claimed and desired to be protected by United States Letters Patent is:

1. A method of minimizing septic holding conditions in a plurality of tanks collecting sewage from a respective plurality of sources for discharging into a main at respective connections upstream to downstream along said main, comprising the steps:

(a) vacuum pumping said main and thereby restraining discharge from said tanks by forcing respective floats down on respective discharge openings in said plurality of tanks;

(b) causing discharge of one of said tanks into the vacuum pumped main by accumulating in said one tank a level of sewage sufficient for raising the float from the discharge opening therein;

(c) promoting discharge of a further one of said tanks having a level of sewage insufficient for raising the float therein against the force of said vacuum pumping by causing the discharge from said one tank to reduce the force of said vacuum pumping at said further one of said tanks;

(d) promoting discharge of yet a further one of said tanks having a level of sewage insufficient for raising the float therein against the force of said vacuum pumping by causing the discharge from said further one of said tanks to reduce the force of said vacuum pumping at said yet a further one of said tanks; and (e) causing repeating of steps (a), (b) or (c) among said plurality of tanks in an order determined by relative collection of sewage in said plurality of tanks, thereby minimizing septic holding conditions in said plurality of tanks.

2. A method of minimizing septic holding conditions in a plurality of tanks collecting sewage from a respective plurality of sources for discharging into a main at respective connections upstream to downstream along said main, comprising the steps:

(a) vacuum pumping said main and thereby restraining discharge from said tanks by forcing respective floats down on respective discharge openings in said plurality of tanks communicating with said vacuum pumped main;

(b) promoting discharge of one of said tanks into said vacuum pumped main by reducing said vacuum pumping to an amount releasing a respective float of at least one of said plurality of tanks from said forcing; and (c) causing said discharge of one of said tanks to reduce further said vacuum pumping and release in cascading sequence further said floats in respective said tanks until substantially all said tanks are discharged, thereby minimizing septic holding conditions in said plurality of tanks.

3. In a system for sewage collection having: a plurality of holding tanks, each with a first connection for receiving sewage and a second connection for discharging sewage into a vacuum pumped main, and a substantial capacity for holding sewage; the improvement comprising: means for providing a substantially large reverse capacity for use in case of vacuum pumping failure, while preventing septic collections from forming in normal operation of said system, including means for causing said discharging from any one of said holding tanks to promote discharge of other of said holding tanks, and said promoted discharge being prior to filling of said other of said holding tanks.

4. In a system as recited in claim 3, said means for causing said discharging from any one of said holding tanks to promote discharge of other of said holding tanks including: each holding tank having therein a float valve with a float of a size for being buoyed up by accumulation of sewage to a level representing a substantially small amount of the capacity of said holding tank, said second connection biasing the float down by means of said vacuum pumped, and said discharging of any one of said holding tanks proportioned for degrading vacuum of said vacuum pumping and releasing said float for being buoyed up by sewage and discharging said other of said holding tanks.

5. In a system as recited in claim 4, said means for causing said discharging from any one of said holding tanks to promote discharge of other of said holding tanks further including: the second connection of each of said holding tanks being spaced longitudinally along said vacuum pumped main from another of said holding tank second connections.

6. In a system as recited in claim 5, said second connection including a respective trap between each of said holding tanks and said vacuum pumped main.

7. In a system for sewage collection having: a plurality of holding tanks, each with a first connection for receiving sewage and a second connection for discharging sewage into a vacuum pumped main, and a substantial capacity for holding sewage; the improvement comprising: means for providing a substantially large reserve capacity for use in case of vacuum pumping failure, while preventing septic conditions from forming in normal operation of said system, including means for causing said discharging from any one of said holding tanks to promote discharge of other of said holding tanks, said promoted discharge being prior to filling of said other of said holding tanks; each said holding tank having a float valve with a float located for being buoyed upward by sewage and thereby discharging sewage from said holding tank and for being biased downward and retaining sewage in said holding tank by pumping of vacuum in said vacuum pumped main, and means for degrading vacuum in said vacuum pumped main and releasing said float for being buoyed upward and discharging sewage from said holding tank.

8. In a system as recited in claim 7, said means for degrading comprising an auxiliary valve.

* * * * *